US005103775A

United States Patent [19]

Hue

[11] Patent Number: 5,103,775

[45] Date of Patent: Apr. 14, 1992

[54] INTERNAL COMBUSTION ENGINE HAVING NON-ALIGNED PISTONS MOUNTED ON ROTATING BASE

[76] Inventor: Angel Hue, Avda. Rafael Soijas No. 6 Edificio Gloria Apt. 2, San Bernardino Caracas, Venezuela

[21] Appl. No.: 584,609

[22] Filed: Sep. 19, 1990

[51] Int. Cl.[5] ..... F02B 57/00

[52] U.S. Cl. ..... 123/43 R; 91/196

[58] Field of Search ..... 123/43 R, 44 R; 91/196, 91/197, 491

[56] References Cited

U.S. PATENT DOCUMENTS

| | | | |
|---|---|---|---|
| 26,009 | 11/1859 | Blair | 91/196 |
| 1,269,722 | 6/1918 | McGann | 123/43 R |
| 1,272,975 | 7/1918 | McGann | 123/43 R |

*Primary Examiner*—Michael Koczo

*Attorney, Agent, or Firm*—Fay, Sharpe, Beall, Fagan, Minnich & McKee

[57] ABSTRACT

An internal combustion engine is mounted on a rotating base. The engine has at least one horizontally arranged cylinder block that is radially spaced outwardly from the center of rotation of the rotating base. The cylinder block has a piston that is connected to a crankshaft for driving the crankshaft in rotation. The axis of rotation of the crankshaft intersects the center of rotation of the rotating base. The crankshaft has an output shaft connected to a speed reducing gear set that drives a pinion. The pinion engages a crown gear fixed about the periphery of the rotating base to drive the rotating base in rotation. An axle fixed to the base at the center of rotation of the base provides an output for the internal combustion engine.

8 Claims, 2 Drawing Sheets

INTERNAL COMBUSTION ENGINE HAVING NON-ALIGNED PISTONS MOUNTED ON ROTATING BASE

FIELD OF THE INVENTION

The invention relates to an internal combustion engine having at least one piston with a cylinder mounted on a rotating base for driving the base in rotation.

BACKGROUND OF THE INVENTION

An internal combustion engine has many sources of energy loss, most of which are considered to be sacrificed in order to obtain a controlled combustion and to provide an output that can be converted to perform useful work. Such losses, such as heat losses and frictional losses can be minimized by the design of the engine. Usually, an engine design reflects a balance of different energy loss considerations that are reached to meet overall design criteria. The compromises that are made and the factors that are considered in designing an internal combustion engine for a particular application are well known to engineers.

Although losses in energy and efficiency are minimized by the design of an internal combustion engine, or compromised in view of the type of work that the internal combustion engine is intended to perform, other energy and efficiency losses are present that are generally not considered to be recoverable. For example, during combustion a piston is typically driven to rotate a crankshaft by applying the force of the combustion to the head of the piston and transmitting this force in the direction toward the crankshaft through the piston connecting rod during the power or work stroke of the piston. According to Newton's third law, however, ("To every action there is an equal and opposite reaction")there is a force (reactive force) equal and opposite to the force that drives the piston in the direction toward the crankshaft, and this force is absorbed by the block and head of the typical internal combustion engine. Since the engine is usually mounted in a fixed arrangement, the reactive force is not utilized to perform useful work.

SUMMARY OF THE INVENTION

It is an object of the present invention to utilize the reactive forces generated during the operation of an internal combustion engine in the performance of useful work by providing an arrangement for mounting an internal combustion engine that, in observation of Newton's third law, utilizes both the force of combustion in a cylinder to drive a piston during the power stroke and the reactive force thus produced as components of the overall output of work of the engine.

DETAILED DESCRIPTION OF THE PREFERRED EMBODIMENT

Figure 1:
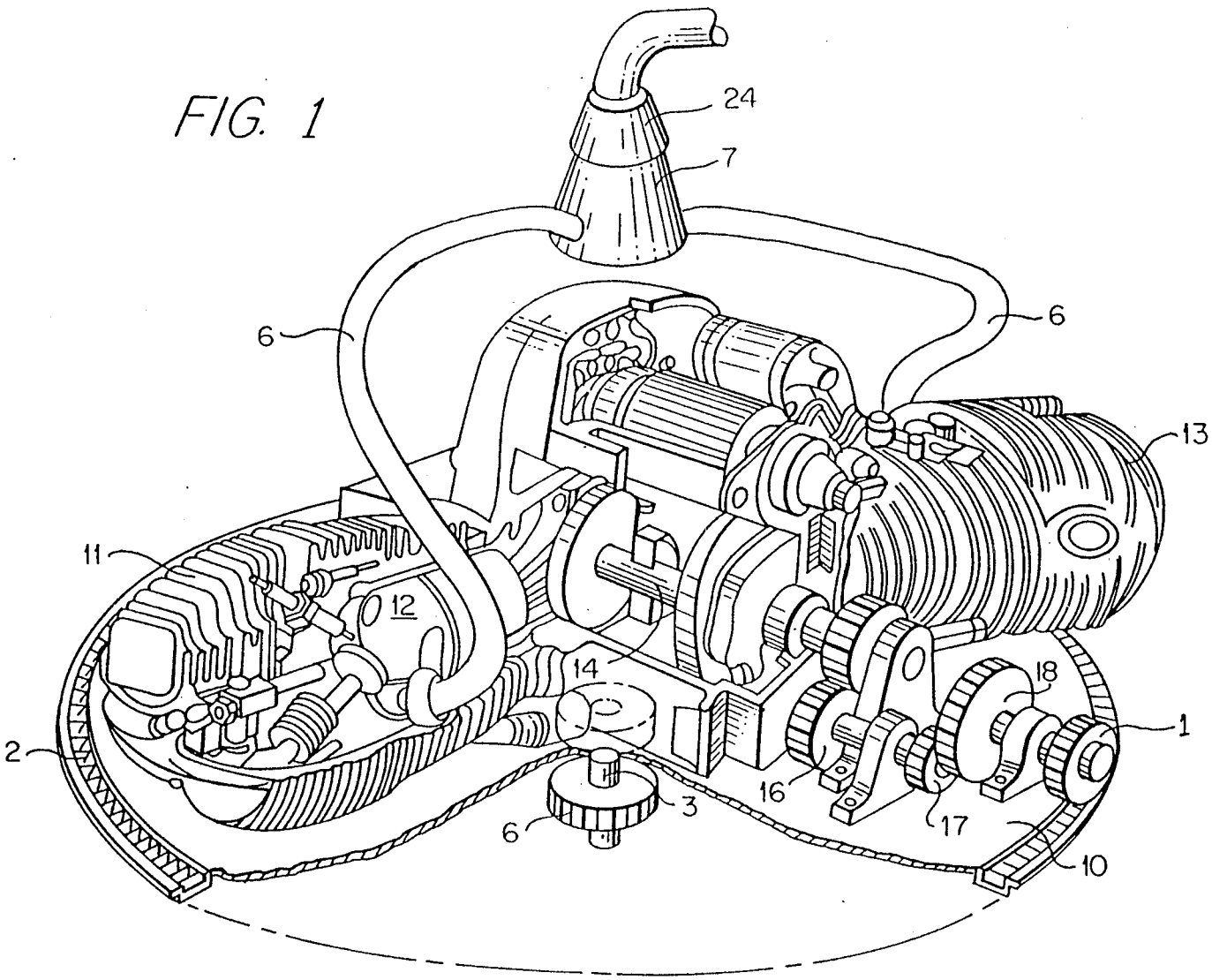
FIG. 1 is a perspective view, partially in section, of the invention showing an internal combustion engine having non-aligned and horizontally opposed pistons with cylinders mounted on a rotating base.
Figure 2:
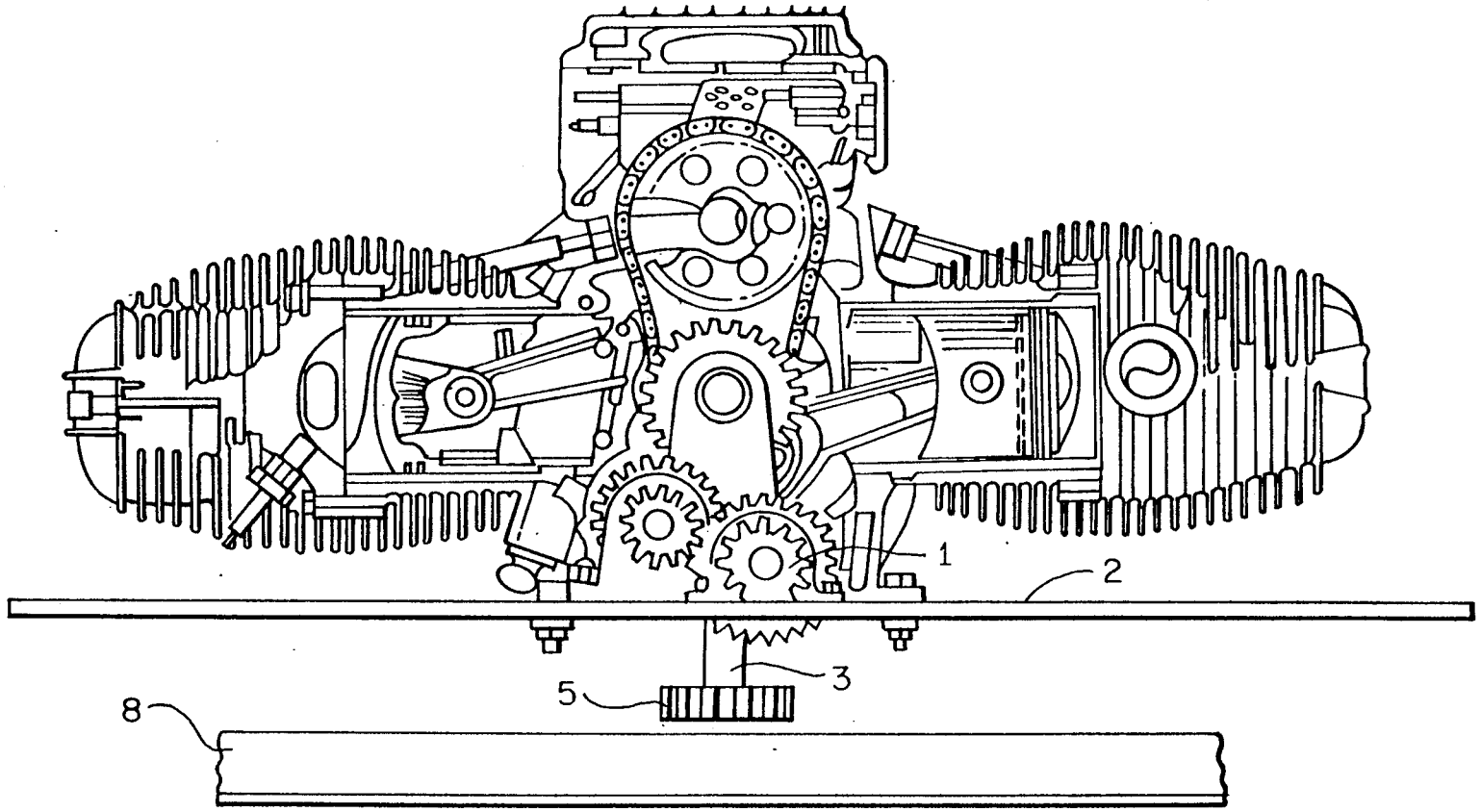
FIG. 2 is a side view, partially in section, of the internal combustion engine and mounting arrangement shown in FIG. 1.

A preferred embodiment of the invention is shown in FIG. 1. The engine is mounted on a base 10 that is mounted for free rotation with respect to a fixed base 8 by a conventional bearing arrangement, not shown. The internal combustion engine is arranged with cylinder blocks 11 and 13 opposite one another, but laterally or radially offset with respect to the center of rotation of rotating base 10.

The components of the internal combustion engine are of a conventional design. For example, most of the components of the internal combustion engine are available from the 900 cc motor cycle engine built by BMW in 1974. Since the internal combustion engine is mounted on rotating base 10, the exhaust is piped from the rotating base by exhaust pipes 6 that communicate with a bell 7 having a fitting that permits relative rotation between bell 7 and a fixed part of an exhaust pipe 24. To supply fuel for the engine, a fuel line, not shown, can be provided internally of the exhaust line connection, or through the center of the rotating base 10 from the opposite side of the rotating base on which the engine is mounted. Preferably, the engine is air cooled.

The pistons are driven by combustion to rotate a crankshaft 14 in a conventional manner. The axis of rotation of crankshaft 14 intersects the axis of rotation of rotating base 10. The crankshaft of the present invention has a longer midportion between the crankthrows than a conventional crankshaft in order to allow the pistons to be separated or non-aligned. The crankshaft has an output shaft that projects out of the engine block on which a gear 15 is fixed. The speed of the crankshaft is reduced through gears 15, 16, 17 and 18. A pinion 1 fixed to a shaft in common with gear 18 rotates, therefore, at a reduced speed with respect to the crankshaft.

Pinion 1 engages a crown gear or circular rack 2 to rotate base 10 with respect to fixed base 8. The output of the engine arrangement is provided by fixing an axle 3 to the center of rotation of rotating base 10, and providing a gear 5, for example, fixed to the axle 3. Axle 3 may be hollow, for example, if the fuel line extends upwardly through rotating base 10 to a rotating sealed fitting to supply gas into a reservoir in communication with the cylinders of the engine, not shown.

In accordance with the present invention, cylinder blocks 11 and 13 are opposed, but not aligned with one another so that the crankpin connection between the connecting rods of the pistons and crankshaft are radially offset with respect to the center of rotation of rotating base 10. In this way, when combustion occurs in one of the cylinders and forces the piston to rotate the crankshaft, thus causing an action (in terms of Newton's third law), an equal and opposite reaction is caused to provide a force acting in the opposite direction that results in a moment being applied about the center of rotation of rotating base 10. The arm of the moment is equivalent to the distance between the crankpin connection for the piston and the center of rotation of rotating base 10.

As a result of providing an output from the center of rotation of rotating base 10 through axle 3, and gear 5, for example, the output has two components of work generated by the internal combustion engine. Mainly, the pinion 1 drives the rotating base 10 by engagement with crown gear or rack 2 to provide the first component, and the reaction force of the combustion and work stroke of the pistons produces a moment about the center of rotation of rotating base 10 as the second component. This second component of work increases the amount of torque applied to the rotating base. The moment is produced because the direction of reciprocating movement of the pistons is arranged to be tangential to a circle having its origin in common with the center of rotation of rotating disk 10 and having a radius that defines the radial or lateral offset of each of the piston and cylinders from the center of rotation of the rotating disk 10.

According to the preferred embodiment, two pistons are disclosed, but one or more pistons can be arranged in the internal combustion engine to provide the two components of output that are produced in accordance with the present invention. When one piston is used, it is spaced from the center of rotation of the rotating base and when more than one piston is used, each of the pistons is spaced from the center of rotation of the rotating base by an equal amount so that the same torque or moment is applied about the center of rotation of the rotating disk 10 by the reactive forces produced during the power cycle of the pistons. Of course, the mounting arrangement ensures that the reactive forces of the pistons produce a moment having a direction of rotation that is in common with the direction of rotation produced by engagement of pinion 1 with crown gear 2.

Preferably, rotating base 10 is mounted to rotate in an essentially horizontal plane with its axis of rotation being vertical. The plane of rotation of the base does not have to be horizontal, however, so long as the reciprocating movement of the pistons is substantially parallel to the plane of rotation of the base.

Although a preferred embodiment has been set forth along with modifications and variations to show specific advantageous details of the present invention, further embodiments, modifications and variations are contemplated within the broader aspects of the present invention, all as set forth by the spirit and scope of the following claims.

I claim:

1. An internal combustion engine, comprising:

at least one piston and corresponding cylinder wherein each piston is connected through a connecting rod to a common crankshaft having an axis of rotation and having an output shaft at one end of the crankshaft said internal combustion engine being mounted on a base mounted for free rotation with respect to a fixed frame, said rotating base having a center of rotation;

drive means mounted on said output shaft and engaging driven means mounted on said fixed frame for driving said rotating base in a first direction of rotation about the center of rotation of the rotating base;

each said piston having a longitudinal axis that is radially offset from said center of rotation of said rotating base and tangential with respect to a circle having its origin in common with said center of rotation, and said crankshaft extending from one side of said base to a diametrically opposite side of said base with said axis of rotation intersecting said center of rotation of said rotating base so that in addition to a driving force produced during a work stroke of each said piston acting on said crankshaft through a respective said connecting rod, for each said piston that is disposed opposite said drive means with respect to said center of rotation a reaction force acting opposite to said driving force produces a moment of rotation about said center of rotation of said rotating base in a second direction that is the same as the first direction of rotation of the rotating base produced by said drive means.

2. An internal combustion engine according to claim 1, wherein said drive means comprises a speed reduction gear set having a driven pinion gear and said driven means includes a crown gear mounted on said fixed frame adjacent and surrounding said rotating base wherein said pinion gear engages said crown gear to drive said base in rotation.

3. An internal combustion engine, comprising:

at least two pistons and respective cylinders therefor wherein each said piston is connected through a respective connecting rod to a common crankshaft driven in rotation by the pistons, comprising:

said internal combustion engine being mounted on a base rotating freely on a fixed frame;

means for driving said rotating base in rotation with respect to said fixed frame, said driving means being interconnected with said crankshaft; and said rotating base having a center of rotation and an output means fixed thereto driven by the output of said internal combustion engine; and each of said pistons of said internal combustion engine reciprocating within said respective cylinders in directions tangential to a circle having an origin at the center of rotation of the rotating base; said crankshaft extending diametrically from one side of said base to an opposite side and having an axis of rotation intersecting the center of rotation of the rotating base; and pairs of said pistons being opposed to one another and connected to said crankshaft at points of connection spaced equally on either side of the center of rotation of the rotating base, respectively.

4. An internal combustion engine according to claim 3, wherein said output means includes an axle fixed to said rotating base a said center of rotation.

5. An internal combustion engine according to claim 3, wherein said internal combustion engine has two pistons and said pistons reciprocate in a plane perpendicular to an axis of rotation of said rotating base.

6. An internal combustion engine according to claim 3, wherein for each one of said pistons of said pairs that is disposed opposite said one side of said base crankshaft with respect to said center of rotation, a reaction force acting opposite to a driving force produced during a work stroke of said one piston acting on said crankshaft through a connecting rod produces a moment of rotation about said center of rotation in the same direction of rotation that said driving means drives said rotating base.

7. An internal combustion engine according to claim 3, wherein said driving means is interconnected with said crankshaft at only one end of said crankshaft.

8. An internal combustion engine according to claim 5, wherein said two pistons are first and second pistons, said first piston is adjacent said driving means and said second piston is opposite said driving means with respect to said center of rotation, respectively, such that a reaction force acting opposite to a driving force produced during a work stroke of said second piston acting on said crankshaft through a connecting rod produces a moment of rotation about said center of rotation in the same direction as the direction of rotation produced by said driving means.

* * * * *